US005365719A

United States Patent [19]

Council

[11] Patent Number: 5,365,719

[45] Date of Patent: Nov. 22, 1994

[54] APPARATUS FOR STORING ITEMS IN A FLEXIBLE WRAPPER AND FOR CLOSING AND OPENING THE MOUTH OF THE FLEXIBLE WRAPPER

[76] Inventor: David S. Council, 907 Walthour Rd., Savannah, Ga. 31410

[21] Appl. No.: 87,258

[22] Filed: Jul. 8, 1993

[51] Int. Cl.[5] ..... B65B 7/12; B65B 51/100; B65B 67/08; B65B 51/04

[52] U.S. Cl. ..... 53/370; 53/390; 53/384.1

[58] Field of Search ..... 53/138.8, 217, 227, 53/370, 390, 483, 492, 384.1

[56] References Cited

U.S. PATENT DOCUMENTS 1,984,894 12/1934 Rose ..... 53/370
3,321,103 5/1967 Phillips ..... 53/390
3,754,371 8/1973 Walker, III ..... 53/483
3,766,703 10/1973 Simon et al. ..... 53/217

*Primary Examiner*—Lowell A. Larson
*Assistant Examiner*—Rodney A. Butler
*Attorney, Agent, or Firm*—Donald A. Kettlestrings

[57] ABSTRACT

Apparatus for holding and storing items, such as bread, contained in a flexible wrapper and for closing and opening a mouth of the wrapper. The apparatus includes a support and a carriage slideably positioned on the support and configured for receiving and holding the items contained in the flexible wrapper. A mechanism is provided in association with the support and the carriage for grasping and for selectively twisting and untwisting the wrapper mouth to close and open the wrapper mouth. Access to the items in the wrapper is provided when the wrapper mouth is opened, and the items are tightly sealed within the wrapper when the wrapper is twisted closed.

11 Claims, 3 Drawing Sheets

APPARATUS FOR STORING ITEMS IN A FLEXIBLE WRAPPER AND FOR CLOSING AND OPENING THE MOUTH OF THE FLEXIBLE WRAPPER

BACKGROUND OF THE INVENTION

This invention relates to apparatus for closing and opening a mouth of a flexible wrapper and more particularly to such apparatus for holding and storing items, such as bread, contained in a flexible wrapper.

Flexible ties or wires are often used for sealing and unsealing the mouths of flexible bread wrappers. Although such flexible ties and wires have served the purpose, they have not proved entirely satisfactory because they can be misplaced or broken, and it is time consuming for the user to twist and untwist the ties or wires to seal and unseal the flexible wrapper.

It is, therefore, an object of the present invention to provide apparatus for holding and storing items, such as bread, contained in a flexible wrapper and for enabling the mouth of the wrapper to be quickly and easily twisted open and closed.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides apparatus for holding items, such as bread, contained in a flexible wrapper and for quickly and easily closing and opening a mouth of the wrapper. The apparatus comprises: a support; a carriage slideably positioned on the support and configured for receiving and holding the items contained in the flexible wrapper; means in operative relationship with the carriage and with the support for facilitating sliding movement of the carriage with respect to the support; and first means in operative relationship with the support and with the carriage for grasping and for selectively twisting and untwisting the wrapper mouth.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate examples of preferred embodiments of the invention and, together with the description, serve to explain the principles of the invention.

DESCRIPTION OF THE PREFERRED EMBODIMENT

Figure 1:
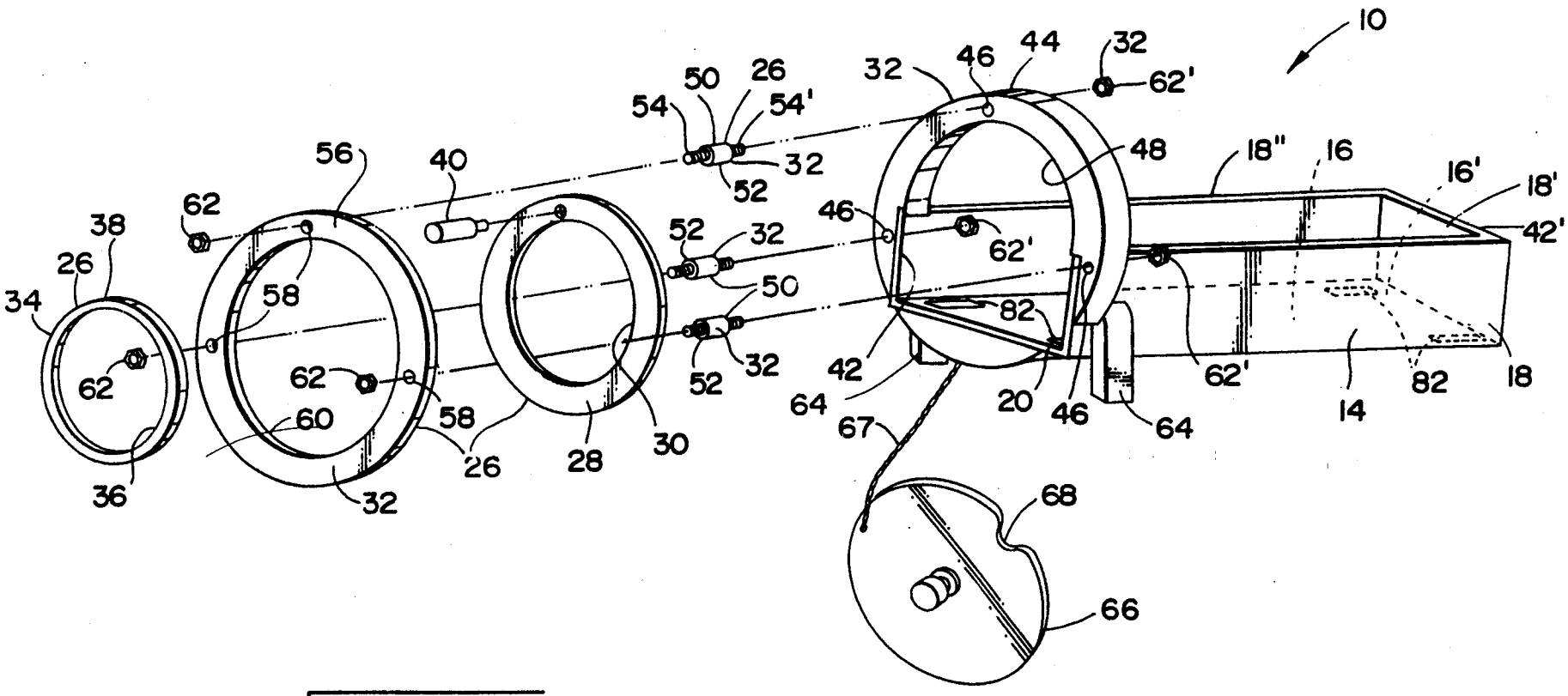
FIG. 1 is an exploded perspective view of the apparatus.
Figure 3:
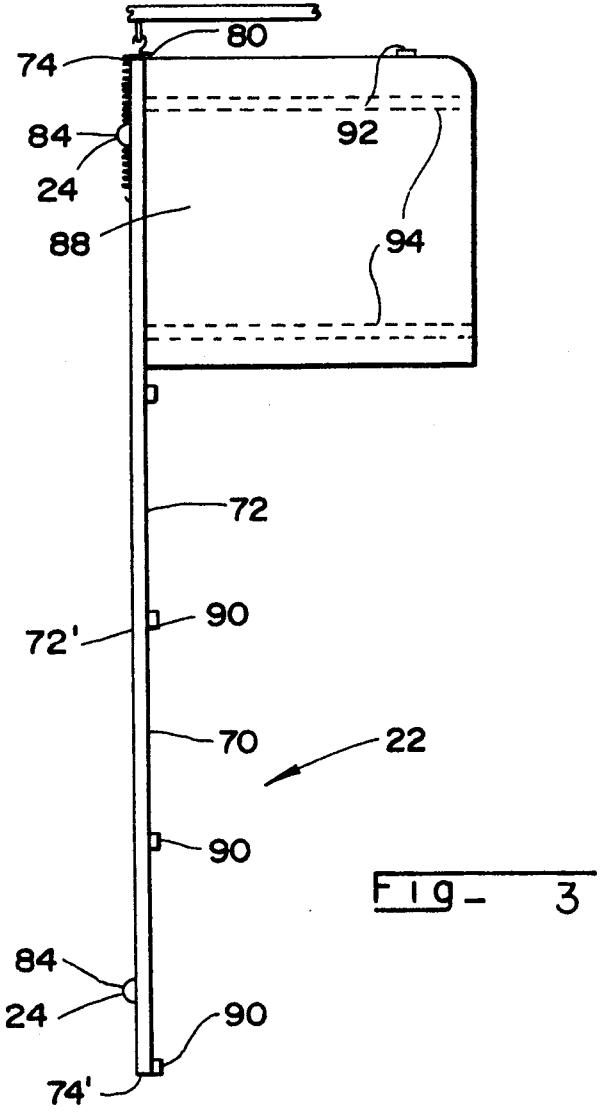
FIG. 3 is a side elevation view of the carriage portion of the apparatus.

With reference now to the drawings, wherein like reference characters designate like or corresponding parts throughout the several views, there is shown apparatus 10 for holding items, such as bread, contained in a flexible wrapper and for closing and opening a mouth of the wrapper.

In accordance with the invention, apparatus 10 comprises a support 14 which preferably includes a floor 16 and three side walls 18, 18' and 18'' extending upwardly from floor 16. A forward portion 20 of support 14 is open-ended.

Apparatus 10 further includes a carriage 22 slideably positioned on floor 16 and configured for receiving and holding items, such as bread, contained in a flexible wrapper.

Means 24 are provided in operative relationship with carriage 22 and with support 14 for facilitating sliding movement of carriage 22 with respect to support 14 and floor 16.

Apparatus 10 further includes first means 26 in operative relationship with support 14 and with carriage 22 for grasping flexible wrapper 12 and for selectively twisting and untwisting the wrapper to respectively close and open the wrapper mouth.

First means 26 include a first ring member 28 which defines a first interior opening 30 therein of a first predetermined shape and a first perimeter dimension. Means 32 are provided in operative relationship with first ring member 28 and with support 14 for rotatably positioning first ring member 28 adjacent to support 14 and adjacent to carriage 22 for enabling the mouth of the flexible wrapper to be positioned through first opening 30 when bread or other items in the wrapper are positioned on carriage 22.

First means 26 further include a second ring member 34 which defines a second interior opening 36 therein and which defines a second exterior perimeter 38 substantially identical to the shape of opening 30 and a predetermined amount smaller than the perimeter dimension of opening 30. When the items in the wrapper are positioned on carriage 22, second ring member 34 can be removably positioned within the open mouth of the wrapper and within opening 30 for engaging and holding the wrapper between perimeter 38 of second ring member 34 and opening 30 of first ring member 28.

A handle 40 is attached to first ring member 28 for enabling an operator to rotate ring member 28 in a first clockwise or counterclockwise direction to twist the mouth of the wrapper to a closed condition, and alternatively, to enable an operator to rotate first ring member 28 in a second, opposite direction to untwist the mouth of the wrapper to an open condition.

Support 14 defines first and second ends 42, 42', and positioning means 32 preferably include a first mounting element 44 attached adjacent to first end 42 of support 14. First mounting element 44 preferably defines three substantially equally spaced mounting holes 46 and a third interior opening 48 therein. A plurality of roller elements 50 are provided, and each of roller elements 50 is comprised of a centrally positioned rotatable cylindrical member 52. First and second bolt members 54, 54' extend axially and in opposite directions from each of cylindrical members 52. One each of roller elements 50 is positioned within and through each of mounting holes 46 so that bolt members 54' extend through each of mounting holes 46.

In accordance with the invention, first ring member 28 is positioned in rotatable engaging relationship within cylindrical members 52, and ring member 28 is supported by cylindrical members 52. A second mounting element 56, which is preferably ring-shaped, defines three mounting openings 58 and a fourth interior opening 60 therein. One each of roller elements 50 is positioned within and through each of mounting openings 58 with bolt members 54 extending through mounting openings 58, and fastening means or nuts 62, 62' are removably threaded onto bolt members 54, 54', respectively, for holding roller elements 50 in position with respect to mounting elements 44, 56. Each of roller elements 50 is configured to enable cylindrical members 52 to freely turn when mounting elements 44, 56 are held together by roller elements 50.

First interior opening 30 is smaller than interior openings 48, 60, and handle 40 extends outwardly through interior opening 60 beyond second mounting element 56 for grasping by an operator.

Support 14 preferably includes leg elements 64 which are attached adjacent to first end 42 of support 14 for supporting first end 42 higher than second end 42'. This orientation of support 14 encourages sliding movement of the wrapped bread loaf, for example, toward second end 42' of support 14, and this movement of the bread loaf, which is enhanced by carriage 22, is important for enabling the mouth of the wrapper to be fully opened as the wrapper mouth is untwisted.

Cover element 66 is provided of a predetermined size and shape to removably fit in frictional engagement within interior opening 60, and cover element 66 defines a notch 68 therein for receiving a portion of handle 40 therein when cover element 66 is properly positioned within interior opening 60.

Carriage 22 of apparatus 10 preferably includes a planar substantially rectangular member 70 which defines upper and lower opposed, substantially flat surfaces 72, 72'. Planar member 70 further defines first and second opposed end edges 74, 74', and first and second opposed side edges 76, 76' extend between end edges 74, 74'. An opening 78 extends inwardly a predetermined distance from first end edge 74.

Facilitating means 24 include a spring 80 positioned within opening 78 and connected to and between planar member 70 and end wall 18' of support 14. Facilitating means 24 also include a plurality of strip elements 82 connected to upper surface 16' of floor 16 in support 14, and a plurality of foot elements 84 are connected to lower surface 72' of planar member 70. Each of foot elements 84 is positioned to engage one of strip elements 82 throughout a predetermined range of relative movement of carriage 22 with respect to support 14. Each of strip elements 82 is preferably made of metal or plastic, and foot elements 84 are preferably metal tacks or plastic elements which will readily slide over strip elements 82.

Figure 2:
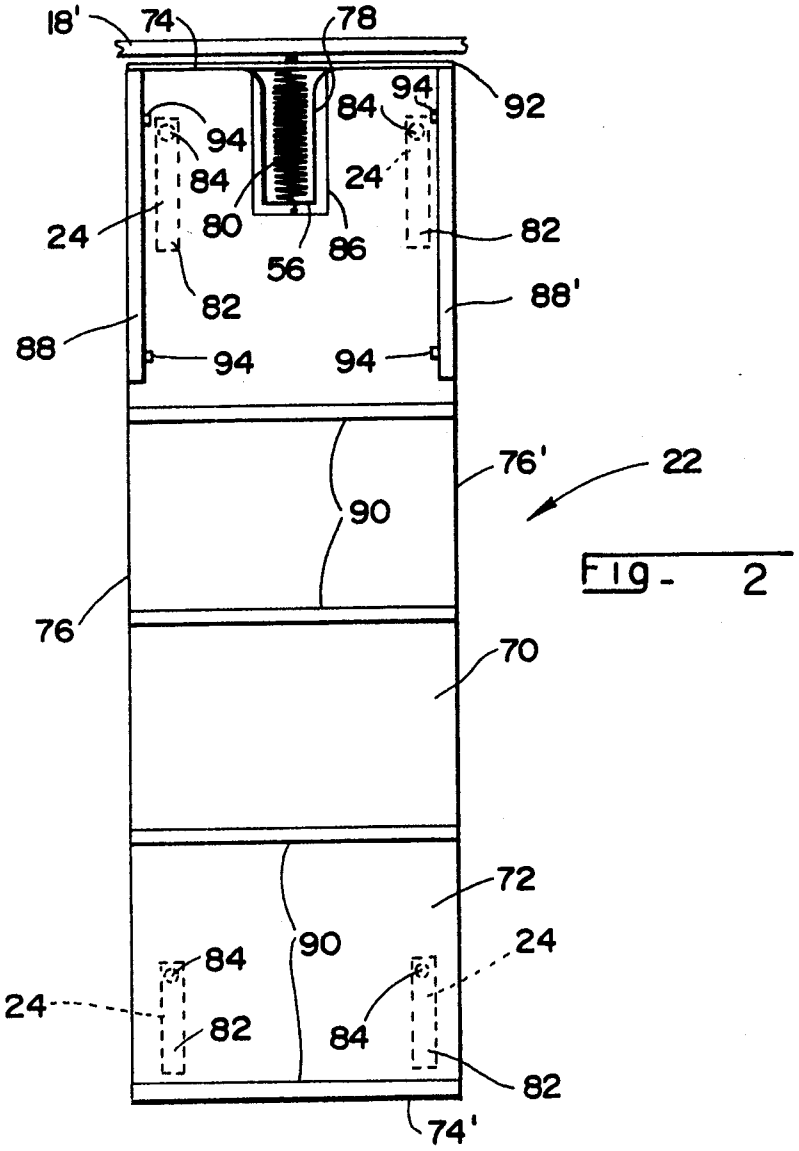
FIG. 2 is a top plan view of the carriage portion of the apparatus.

Carriage 22 preferably includes a cover element 86 (FIG. 2) attached to upper surface 72 of planar member 70, and cover element 86 extends over opening 78 and over spring 80 to prevent interference or entangling of the flexible wrapper with spring 80.

Carriage 22 also preferably includes first and second opposed side support members 88, 88' which are attached to planar member 70 adjacent to end edge 74 and extend upwardly from side edges 76, 76', respectively. A plurality of spaced apart support strips 90 are attached to upper surface 72 and each of strips 90 extends substantially between side edges 76, 76' of planar member 70. Brace members 92, 94 are preferably provided to enhance the rigidity and strength of side support members 88, 88'.

Figure 4:
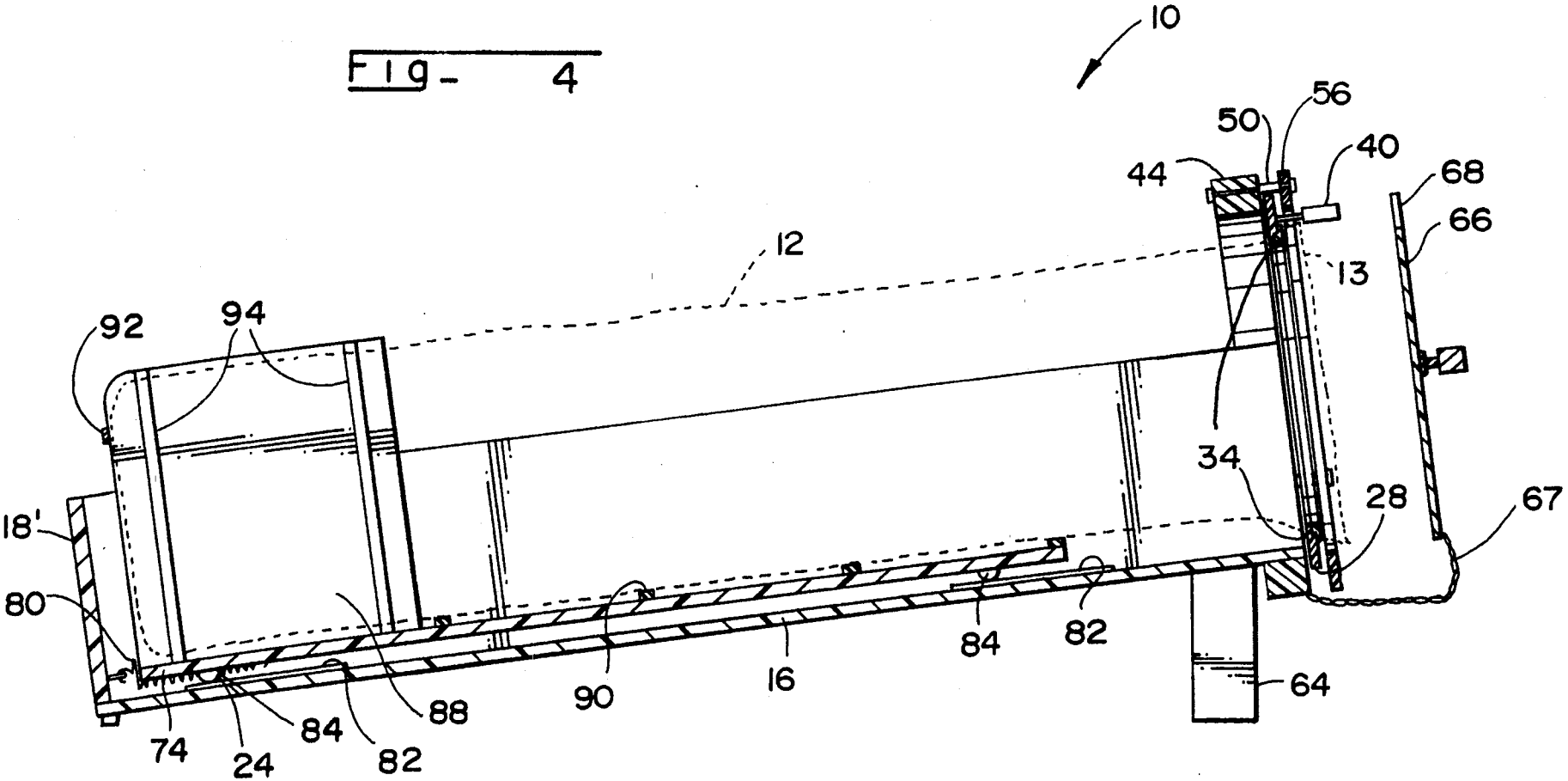
FIG. 4 is a cross-sectional view of the apparatus taken substantially along the center line thereof.

In operation and use, bread or other items contained in a flexible wrapper 12 (FIG. 4) are positioned within support 14 and at rest on carriage 22. Mouth 13 of flexible wrapper 12 is positioned adjacent to forward end 42 of support 14. Mouth 13 of wrapper 12 is then opened and positioned through interior opening 30 of ring member 28. Second ring member 34 is then positioned within open mouth 13 and within opening 30 to engage and hold wrapper 12 between perimeter 38 of ring member 34 and opening 30 of ring member 28.

Handle 40 is then grasped by the operator and used to rotate ring member 28 and ring member 34 in either a clockwise or counterclockwise direction. This rotation twists mouth 13 of flexible wrapper 12 to a tightly closed condition when ring member 28 and ring member 34 have been turned approximately one complete revolution. Handle 40 can then be released by the operator, and the weight of ring members 28 and 34 will act to hold mouth 13 of wrapper 12 in the tightly twisted and closed position even after handle 40 has been released. Cover 66 can then be placed into position within interior opening 60, and a portion of handle 40 is positioned within notch 68 of cover 66 so that the cover will frictionally engage interior opening 60. Cover 66 is preferably attached to support 14 by a flexible line or connecting element 67.

When access to the bread or other items within flexible wrapper 12 is desired, cover 66 is removed and handle 40 is grasped by the operator to rotate ring members 28 and 34 in an opposite direction to untwist mouth 13 of wrapper 12 to an open position. As mouth 13 is untwisted, the weight of the bread or other items and the action of spring 80 causes carriage 22 to be drawn away from forward end 42 of support 14 and toward rearward end 42'. This, in turn, pulls the bread or other items and wrapper 12 away from forward end 42 to enable mouth 13 to fully open as mouth 13 is untwisted by the rotation of ring members 28 and 34. Typically, a single revolution of ring members 28 and 34 will completely open mouth 13 of wrapper 12 to provide access to the bread or other items within wrapper 12.

The low friction contacts between foot elements 84 and strip elements 82 enhance the ability of carriage 22 to slide in relation to support 14.

Support strips 90 and cover element 86 support the bread or other items within wrapper 12 within carriage 22, and cover element 86 prevents interference of wrapper 12 with the action of spring 80.

The invention in its broader aspects is not limited to the specific details shown and described, and departures may be made from such details without departing from the principles of the invention and without sacrificing its chief advantages.

What is claimed is:

1. Apparatus for holding items contained in a flexible wrapper and for closing and opening a mouth of the wrapper, said apparatus comprising:

a support;

a carriage slideably positioned on said support and configured for receiving and holding said items contained in said flexible wrapper;

means in operative relationship with said carriage and with said support for facilitating sliding movement of said carriage with respect to said support; and first means in operative relationship with said support and with said carriage for grasping and for selectively twisting and untwisting said wrapper mouth to close and open, respectively, said wrapper mouth.

2. Apparatus as in claim 1 wherein said first means include:

a first ring member defining a first interior opening therein of a first predetermined shape and a first perimeter dimension;

means in operative relationship with said first ring member and with said support for rotatably positioning said first ring member adjacent to said support and said carriage for enabling said wrapper mouth to be positioned through said first opening when said items in said wrapper are positioned on said carriage;

a second ring member defining a second interior opening therein and defining a second exterior perimeter of said first shape and a predetermined amount smaller than said first perimeter dimension;

said second ring member removably positionable within said open wrapper mouth and within said first opening for engaging and holding said wrapper between said second ring member perimeter and said first opening; and a handle attached to said first ring member for enabling an operator to rotate said first ring member in a first direction to twist said wrapper mouth to a closed condition and alternatively to enable an operator to rotate said first ring member in a second direction to untwist said wrapper mouth to an open condition.

3. Apparatus as in claim 2 wherein said support defines first and second ends and wherein said positioning means include:

a first mounting element attached adjacent to said first end of said support and defining three mounting holes and a third interior opening within said first mounting element;

a plurality of roller elements, one each positioned within and through each of said mounting holes;

said first ring member positioned in movable engaging relationship with and supported by said roller elements;

a second mounting element defining three mounting openings and a fourth interior opening within said second mounting element;

one each of said roller elements positioned within and through each of said mounting openings; and fastening means removably connected to said roller elements for holding said roller elements in position with respect to said first and second mounting elements.

4. Apparatus as in claim 3 wherein said handle extends outwardly through said fourth interior opening beyond said second mounting element for grasping by an operator.

5. Apparatus as in claim 4 wherein said first interior opening is smaller than said third and fourth interior openings.

6. Apparatus as in claim 5 further including at least one leg element attached adjacent to said first end of said support for raising said first end of said support higher than said second end of said support.

7. Apparatus as in claim 6 further including a cover element of a predetermined size and shape to removably fit in frictional engagement within said fourth interior opening, said cover element defining a notch therein for receiving a portion of said handle therein when said cover element is positioned within said fourth interior opening.

8. Apparatus as in claim 1 wherein said carriage includes:

a planar member defining upper and lower opposed substantially flat surfaces, first and second opposed end edges, first and second opposed side edges extending between said end edges and an opening extending inwardly a predetermined distance from said first end edge;

said facilitating means including a spring positioned within said opening and connected to and between said planar member and said support for moving said carriage away from said first means.

9. Apparatus as in claim 8 wherein said facilitating means further include:

a plurality of strip elements connected to said support; and a plurality of foot elements connected to said lower surface of said planar member and positioned to engage said strip elements throughout a predetermined range of relative movement of said carriage with respect to said support.

10. Apparatus as in claim 9 wherein said carriage further includes a cover element attached to said upper surface of said planar member and extending over said opening and over said spring.

11. Apparatus as in claim 10 wherein said carriage further includes:

first and second opposed side support members attached to said planar member adjacent to said first end edge and extending upwardly from said first and second side edges, respectively; and a plurality of spaced apart support strips attached to said upper flat surface and extending substantially between said first and second side edges.

* * * * *